US006106588A

United States Patent [19]

Skibo et al.

[11] Patent Number: 6,106,588

[45] **Date of Patent: *Aug. 22, 2000**

[54] PREPARATION OF METAL MATRIX COMPOSITES UNDER ATMOSPHERIC PRESSURE

[75] Inventors: Michael D. Skibo, Leucadia; David M. Schuster, La Jolla, both of Calif.

[73] Assignee: MC21 Incorporated, San Diego, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 09/041,542

[22] Filed: Mar. 11, 1998

[51] Int. Cl.[7] ..... C22B 21/06

[52] U.S. Cl. ..... 75/684; 75/678; 266/216

[58] Field of Search ..... 266/233, 235, 266/216; 75/678, 674, 684

[56] References Cited

U.S. PATENT DOCUMENTS

| | | | |
|---|---|---|---|
| 3,728,108 | 4/1973 | Sifferlen et al. | 75/135 |
| 3,858,640 | 1/1975 | Sifferlen | 164/250 |
| 4,557,605 | 12/1985 | Kenney et al. | 366/134 |
| 4,618,427 | 10/1986 | Venas | 210/629 |
| 4,759,995 | 7/1988 | Skibo et al. | 428/614 |
| 4,786,467 | 11/1988 | Skibo et al. | 420/129 |
| 4,865,806 | 9/1989 | Skibo et al. | 420/129 |
| 4,865,808 | 9/1989 | Ichikawa et al. | 428/548 |
| 4,901,780 | 2/1990 | Sasaki et al. | 164/4.1 |
| 4,943,413 | 7/1990 | Tank | 420/528 |
| 4,961,461 | 10/1990 | Klier et al. | 164/461 |
| 5,025,849 | 6/1991 | Karmarkar et al. | 164/97 |
| 5,083,602 | 1/1992 | Skibo | 164/97 |
| 5,167,920 | 12/1992 | Skibo et al. | 420/548 |
| 5,186,234 | 2/1993 | Hammond et al. | 164/97 |
| 5,364,450 | 11/1994 | Eckert | 75/678 |
| 5,394,928 | 3/1995 | Hammond et al. | 164/97 |
| 5,402,843 | 4/1995 | Skibo | 164/97 |
| 5,531,425 | 7/1996 | Skibo et al. | 266/208 |

FOREIGN PATENT DOCUMENTS 1982-143456 9/1982 Japan .

OTHER PUBLICATIONS

R. Asthana, "Cast Metal–Matrix Composites. I: Fabrication Techniques," Journal of Materials Synthesis and Processing vol. 5(4): pp. 251–278 (Dec. 1997).

R. Asthana, "Cast Metal–Matrix Composites. II: Process Fundamentals," Journal of Materials Synthesis and Processing vol. 5(5): pp. 339–361 (Dec. 1997).

R. Asthana, "Review: Reinforced Cast Metals, Part I Solidification Microstructure," Journal of Materials Science vol. 33: pp. 1679–1698 (Dec. 1998).

R. Asthana, "Review: Reinforced Cast Metals, Part II Evolution of the Interface," Journal of Materials Science vol. 33: pp. 1959–1980 (Dec. 1998).

*Primary Examiner*—Scott Kastler

*Attorney, Agent, or Firm*—Wagner, Murabito & Hao LLP

[57] ABSTRACT

A method and apparatus are provided for mixing nonmetallic reinforcing particles into a molten metal or metal alloy for the production of stir-cast metal matrix composite (MMC) materials under atmospheric or near-atmospheric pressure. In a preferred embodiment, the particles are introduced into the matrix under the surface of the matrix by feeding the particles through the inner passage of a rotatable hollow impeller tube positioned in the matrix. The impeller tube is terminated at its lower end by an impeller head. The impeller head includes one or more teeth and is positioned proximate to an impeller base. The particles enter the matrix through a shear region which exists in and around the volume between the impeller base and the impeller head. The rotating impeller and the high shear force thereby created wet the particles in the composite matrix and effect homogenization of the composite matrix. The particles are preferably fed into the matrix from a particle supply that is back-filled with an active gas like oxygen or a substantially inert gas. The process of the present invention may be practiced as a batch process or as a continuous process.

15 Claims, 2 Drawing Sheets

OTHER PUBLICATIONS

A. Luo, "Processing, Microstructure, and Mechanical Behavior of Cast Magnesium Metal Matrix Composites," Metallurgical and Materials Transactions A vol. 26A: pp. 2445–2455 (Dec. 1995).

S. Ray, "Review: Synthesis of Cast Metal Matrix Particulate Composites," Journal of Materials Science vol. 28: pp. 5397–5413 (Dec. 1993).

S. Ray, "Casting of Metal Matrix Composites," Key Engineering Materials vol. 104–107: pp. 417–446 (Dec. 1995).

M. Gupta et al., "Processing–Microstructure–Mechanical Properties of A1 Based Metal Matrix Composites Synthesized Using Casting Route," Key Engineering Materials vol. 104–107: pp. 259–274 (Dec. 1995).

K. Xiao et al., "On the Distribution of Particulates in Cast Metal Matrix Composites," Journal of Reinforced Plastics and Composites vol. 15: pp. 1131–1148 (Dec. 1996).

V. Kevorkijan, "An Ideal Reinforcement for Structural Composites," American Ceramic Society Bulletin: pp. 61–67 (Dec. 1997).

P. Rohatgi, "Future Directions in Solidification of Metal Matrix Composites," Key Engineering Materials vol. 104–107: pp. 293–312 (Dec. 1995).

P. Rohatgi et al., "Cast Aluminum Alloy–Fly Ash Composites," Key Engineering Materials vol. 104–107: pp. 283–292 (Dec. 1995).

K. Sukamaran et al., "The Effects of Magnesium Additions on the Structure and Properties of A1–7 Si–10 $SiC_p$ Composites," Journal of Materials Science vol. 30: pp. 1469–1472 (Dec. 1995).

Y. Chen et al., "In Situ A1–TiB Composite Obtained by Stir Casting," Journal of Materials Science vol. 31: pp. 311–315 (Dec. 1996).

K. Yamada et al., "The Optimum Condition of Compocasting Method for the Particle Reinforced MMC," 34th International SAMPE Symposium: pp. 2266–2277 (Dec. 1989).

R. Mehrabian et al., "Preparation and Casting of Metal–Particulate Non–Metal Composites," Metallurgical Transactions vol. 5: pp. 1899–1905 (Dec. 1974).

A. Sato et al., "Aluminum Matrix Composites: Fabrication and Properties," Metallurgical Transactions B vol. 7B: pp. 443–451 (Dec. 1976).

B. F. Quigley et al., "A Method for Fabrication of Aluminum–Alumina Composites," Metallurgical Transactions A vol. 13A: pp. 93–100 (Dec. 1982).

A. Mortensen et al., "The Status of Metal–Matrix Composite Research and Development in Japan," Journal of Metals: pp. 10–18 (Dec. 1993).

M. K. Surappa et al., "Preparation and Properties of Cast Aluminum–Ceramic Particle Composites," Journal of Materials Science vol. 16: pp. 983–993 (Dec. 1981).

M. Kobashi et al., "Effects of Alloying Elements on SiC Dispersion in Liquid Aluminum," Materials Transactions, JIM vol. 31: pp. 1101–1107 (Dec. 1990).

H. Moon et al., "Rheological Behavior of SiC Particulate–(Al–6.5wt.%Si) Composite Slurries at Temperatures Above the Liquidus and Within the Liquid+Solid Region of the Matrix," Materials Sciences and Engineering vol. A144: pp. 253–265 (Dec. 1991).

P. Rohatgi et al., "Friction and Abrasion Resistance of Cast Aluminum Alloy–Fly Ash Composites," Metallurgical and Materials Transactions A vol. 28A: pp. 245–250 (Dec. 1997).

P. Rohatgi et al., "Low Cost Cast Aluminum–Fly Ash Composites for Ultralight Automotive Application," in *Automotive Alloys*: pp. 157–169 (Dec. 1997).

R. Guo et al., "Casting Characteristics of Aluminum Alloy, Fly Ash Composites," AFS Transactions vol. 166: pp. 1097–1101 (Dec. 1996).

A. Mortensen et al., "Solidification Processing of Metal Matrix Composites," International Materials Reviews vol. 37: pp. 101–128 (Dec. 1992).

C. May, "An Economical, Net Shape Process for Metal Matrix Composites," Technical Paper presented at Society of Manufacturing Engineers, Metal Matrix Clinic. (Dec. 1990).

C. Vives, "Elaboration of Metal Matrix Composites from Thixotropic Alloy Slurries Using a New Magnetohydrodynamic Caster," Metallurgical Transactions B vol. 24B: pp. 493–510 (Dec. 1993).

O. Ilegbusi et al., "Methematical Modeling of the Electromagnetic Stirring of Molten Metal–Solid Suspensions," Transactions ISIJ vol. 28: pp. 97–103 (Dec. 1988).

A. Mortensen et al., "Solidification Processing of Metal–Matrix Composites," Journal of Metals vol. 40: pp. 12–19 (Dec. 1988).

P. Rohatgi et al., "Solidification, Structures, and Properties of Cast Metal–Ceramic Particle Composites," International Metals Reviews vol. 31: pp. 115–139 (Dec. 1986).

J. Cornie et al., "A Review of Semi–Solid Slurry Processing of A1 Matrix Composites," Proceedings of an ASM International Conference on Fabrication of Particulates Reinforced Metal Composites: pp. 63–78 (Dec. 1990).

Existing Stir-Cast Technology

PREPARATION OF METAL MATRIX COMPOSITES UNDER ATMOSPHERIC PRESSURE

FIELD OF THE INVENTION

This invention relates generally to the preparation of metal matrix composite (MMC) materials and, more particularly, to an apparatus and method for mixing nonmetallic reinforcing particles into molten metals or metal alloys for the preparation of stir-cast MMC materials under atmospheric or near-atmospheric pressure.

BACKGROUND OF THE INVENTION

Metal matrix composites (MMCs), particularly those based upon aluminum alloys, have gained increasing popularity and recognition as alternative structural materials, especially for applications requiring increased stiffness, wear resistance, and strength. MMCs are usually produced by mixing nonmetallic reinforcing particles such as grit, powder, fibers or the like into a metallic matrix. For example, aluminum-based MMCs are composed typically of aluminum alloys (e.g., 6061, 2024, 7075, or A356) reinforced with ceramic particles such as silicon carbide or aluminum oxide (alumina) powder. The reinforcement provided by these particles contributes strength, stiffness, hardness, and wear resistance, in addition to other desirable properties, to the composite.

Despite their growing market, the high cost of manufacturing MMCs has hampered their ability to be priced competitively with unreinforced metallic materials. Traditionally, the fabrication of metal matrix composites has employed non-liquid methods such as the compaction of blends of ceramic particles or fibers and aluminum powders, or the metal spraying of continuous fibers in a lay-up process. Unfortunately, the high cost of metallic powders and the explosion and pyrophoric hazards associated with large quantities of powders have prevented a significant reduction in the cost of MMCs produced by this approach.

Numerous researchers have reported the preparation of MMCs by mixing various ceramic powders and fibers into molten aluminum-based matrices. The equipment and methods utilized in many of these early experiments were extremely simple. The equipment usually consisted of a heated crucible containing molten aluminum alloy and a motor to rotate a paddle-style impeller made of graphite or coated steel in the molten aluminum while ceramic particles were added to the surface of the molten metal (i.e., the melt). The vortex formed by the rotating impeller drew the ceramic particles into the melt and the shear developed between the impeller and the walls of the crucible helped wet the particles. The temperature was usually maintained below the liquidus temperature (in the two-phase region) to keep the aluminum alloy in a semi-solid condition, since the higher viscosity of the partially solid melt further increased the shear force created by the simple impeller. This process has been called compocasting.

Unfortunately, the MMCs made by the compocasting process and other early stir-cast methods suffered from various problems. For example, these early experiments typically involved only small batches. In addition, the processes were performed under atmospheric pressure, using either ambient air or an inert gas to cover the molten metal. In either case, the turbulence created by the mixing process aspirated a significant amount of gas. As a result, the vortex formed by the impeller rotation drew considerable amounts of air or gas down into the melt. Because the composite is sensitive to turbulence and the particles act as sites for the entrapment of gas bubbles, the solidified composites produced by these early processes were often porous. In addition, it was common for the stir-cast or compocast MMCs to contain numerous oxide skins due to the passing of the particles through the surface oxide into the body of the melt. Another problem with the compocasting process was the low level of shear developed by the rotating impeller in the semi-liquid matrix. Since shear is needed for wetting, the particles were generally incompletely wetted by the molten metal alloys. In sum, the quality of the composites produced by these early stir-cast approaches was poor and not considered commercially viable.

The aforementioned compocasting process and other prior stir-cast processing techniques used in the manufacture of metal matrix composite materials are described in detail in U.S. Pat. No. 5,531,425 to Skibo et al., the disclosure of which is incorporated herein by reference. Little or no improvement in these processes occurred until the development of a stir-cast process performed under vacuum, known as the Duralcan process.

Today, Duralcan, a division of Alcan Aluminum Corporation, is a leader in the manufacture and sale of stir-cast aluminum-based MMCs. The technological development which led to the Duralcan process is based on an improvement in mixing efficiency combined with a reduction in gas entrapment. In this process, a low vacuum of approximately 1–5 torr is drawn over molten aluminum heated above the liquidus temperature (in the fully liquid region). The reinforcing particles are added to the surface of the melt and an impeller capable of creating a moderately high level of shear in a low viscosity melt is inserted into the molten metal and stirred at high rotational speed, as measured in revolutions per minute (rpm). The vacuum removes the air which tends to act as a buffer, cushioning the particles and preventing intimate contact with the metal. With the particles in contact with the metal from the start of the process, wetting can begin immediately. The high shear impeller physically shears the particles into the aluminum alloy, spreading the aluminum over the high surface area of the fine particles, thereby rapidly wetting them. The quality of the resulting MMC is much improved over that produced by the other techniques described above. The particles are essentially 100% wetted and there is little or no porosity in the Duralcan MMC. However, while the end product of the Duralcan process is of high quality, the high cost of manufacture, due in large part to the inefficiency of particle mixing and the requirement of costly vacuum equipment, has prevented Duralcan from fully exploiting the potential MMC market.

The Duralcan process is a vacuum batch process that can be divided into three general stages. The first stage is the incorporation of the particles into the molten aluminum, i.e., bringing the particles into intimate contact with the aluminum so that wetting can begin. This stage relies on the formation of a vortex to draw the particles into the body of the melt and a vacuum for eliminating the cushioning effect of gas at atmospheric pressure. In the second stage, the particles must be sheared in the melt through the use of a rotating impeller which produces high shear force. In general, the impeller must have sharp teeth and rotate at sufficient rotational speed in order to break up agglomerates of particles such that each particle may individually come into contact with the aluminum melt. The rotational speed requirement seems to be related to a minimum level of shear generated at a specific surface velocity of the impeller in the melt. Typically, if the rotational speed of the impeller, as measured in rpm, is too low and/or the edges of the teeth are dull, low porosity MMC material comprising well-wetted particles cannot be produced. To further enhance the level of shear, a stationary bar or baffle is positioned proximate to the perimeter of the rotating impeller. A small region of increased shear is created between the outer periphery of the impeller and the baffle. The third stage involves the slow general motion of the composite in the mixing vessel so that substantially all of the composite eventually passes through the area of high shear several times. This motion also ensures uniformity of particle distribution throughout the batch.

However, the Duralcan process, and other similar stir-cast processes practiced presently, have certain shortcomings and disadvantages. In particular, the wetting of the particles, which is the main objective of mixing, begins only when the ceramic particles that are poured on the surface of the molten metal move downward through the matrix towards the rotating impeller. This process proceeds at a slow rate because the vortex is comparatively small and the downward motion is not especially strong; also, localized shear is provided only in the proximity of the baffle. Furthermore, because the ceramic particles are added to the matrix surface, the particle feed rate must be carefully controlled so as to prevent the accumulation of particles on the surface which can, in turn, choke the agitator and further slow the mixing process. Although the impeller and baffle system is simple, rugged, and easy to repair, it is inefficient and does not take advantage of the potential region of high shear which could be made to completely surround the rotating impeller. As a result, the wetting process takes much longer than necessary because the particles must pass through the narrow shear region between the impeller and the baffle several times before the agglomerates are dispersed and the molten aluminum uniformly contacts and wets each particle.

The inefficient mixing of large quantities of MMCs also produces defects in the molten composite. More specifically, agglomerates of incompletely wetted particles may become encased in heavy stable oxide skins which form as the particles roll on the melt surface oxide before submerging and moving towards the impeller. If the oxide coating is thick, the mixing process will sometimes have insufficient intensity to break the agglomerates into individually wetted particles regardless of mixing duration. These partially wetted agglomerates persist after mixing and can lead to internal and surface defects which may be detrimental to properties such as fatigue and fracture. The aluminum oxide skins also have a detrimental effect on the MMC product, because they increase the viscosity of the composite matrix during the casting process and limit the ability to cast intricate shapes having thin walls.

One of the major cost factors in the manufacture of stir-cast aluminum MMCs is the time required to mix particles into molten aluminum so that the individual particles are thoroughly wetted and uniformly distributed in the composite. Prior attempts at increasing the rate of particle wetting and decreasing the process time for particle mixing have not been wholly successful. For example, Sifferlin, in U.S. Pat. No. 3,858,640, describes the introduction of reinforcing particles into molten metal by blowing the particles into the melt using a neutral gas. This process, however, requires large amounts of gas to carry the particles. Thus, the gas becomes entrapped in the composite matrix, which is extremely sensitive to gas and turbulence, and results in a porous composite product. Others have described a process in which the particles are plunged under the surface of the composite melt during mixing with a mechanical hand cylinder. This process, however, produces MMCs with numerous oxide skins since the particles are pushed down through the surface oxide into the body of the matrix.

Another significant cost factor is the use of vacuum which requires that the melting and mixing equipment be encased in a vacuum chamber. Vacuum processing also necessitates additional costly hardware, such as pumps and valves, which complicates the process and increases the time required to make the MMC material.

Thus, there exists a continuing need for an apparatus and method for preparing MMC materials which obviate the sources of increased costs found in the prior manufacturing processes, namely, inefficient mixing of particles and the need for vacuum equipment. The present invention fulfills these needs and further provides related advantages, while avoiding or eliminating many of the problems and shortcomings of the prior art processes. For example, if high quality MMCs could be manufactured under atmospheric or near-atmospheric pressure, such a process could be carried out in many foundries and cast houses where end users could make the MMCs and convert them directly into end products without the need for remelting small ingots with the associated melting costs and melt losses. In addition, an MMC manufacturing process that is performed under atmospheric pressure may be performed as a continuous, rather than batch, process where, for example, ceramic powder and molten aluminum are mixed together and a stream of liquid MMC is produced. A continuous process would dramatically reduce MMC cost as well as provide a way of meeting the potentially enormous MMC market needs.

SUMMARY OF THE INVENTION

The present invention obviates the foregoing problems and provides a method and apparatus for preparing metal matrix composite (MMC) materials under atmospheric or near-atmospheric pressure. The apparatus and process of this invention permit rapid and efficient mixing of particles into a matrix and, in addition, eliminate the need for expensive vacuum equipment. As a result, the cost of preparing MMC materials can be significantly reduced, such that MMCs can be priced competitively with unreinforced metals and metal alloys.

In accordance with one embodiment of the present invention, a method and apparatus for mixing particles into a molten metal or metal alloy for the production of stir-cast metal matrix composite materials are provided. This production process is made more efficient than prior art processes by increasing both the rate of wetting and the speed at which the particles can be added to the melt. In this process, mixing of the particles is improved by increasing the level of shear, as well as the size and location of the shear region. In part, the increase in shear is accomplished by increasing the rotational speed of the impeller. In addition, the shear region is positioned at the very location at which the particles are introduced into the matrix, thereby decreasing the time required for the particles to reach the shear region and significantly increasing the fraction of particles which pass through the shear region. Moreover, the particles are introduced into the matrix under the matrix surface, thereby avoiding the introduction of oxide skins into the MMC.

One embodiment of the present invention includes an impeller useful for mixing particles into a matrix contained in a vessel. Preferably, the impeller comprises a hollow impeller tube having an inner passage into which particles may be directed. The particles may then be directed through the inner passage and eventually be introduced into the body of the matrix through an open end of the impeller tube at an introduction point below the surface of the matrix. The impeller tube may further include an impeller head that projects radially outward from the impeller tube. It is particularly preferred that the impeller head is positioned in close proximity to an impeller base, which preferably has contours that are generally complementary to the impeller head. It is preferred that the impeller base is similar in size and shape to the impeller head so that a region of high shear exists in the volume generally between and around the impeller base and the impeller head. The impeller head preferably has one or more teeth to provide the impact forces which aid in breaking up and dispersing particle agglomerates and to entrain a larger amount of the matrix during rotation of the impeller.

In another embodiment of the present invention, the particles are pumped (i.e., mechanically driven under force) from, for example, a container back-filled with an active gas such as oxygen or a substantially inert gas and introduced to the matrix body at a point under the matrix surface. The particle container is preferably sealed so that there is no substantial gas leakage from the container. For the production of MMC materials, the surface of the reactive molten metal or alloy in the vessel is preferably physically covered to prevent the formation of a vortex in the melt and thereby to minimize turbulence at the matrix surface. Optionally, the melt may also be blanketed with a substantially inert gas (e.g., argon, helium, or nitrogen) to protect the melt from reacting with the atmosphere. In this embodiment, the need for vacuum equipment is obviated and the process may be carried out under atmospheric or near-atmospheric pressure. Importantly, because the need for vacuum is eliminated, the process need not be a batch process. The present invention may be performed as a continuous process in which liquid metal or alloy may be fed continuously into the mixing vessel while the composite is withdrawn from the vessel.

It will now be apparent from the foregoing that the method and apparatus of the present invention present a significant advance generally in the region of particle mixing and, more particularly, in the region of manufacturing metal matrix composite materials. In particular, the present invention avoids or minimizes many of the shortcomings of the prior art, while significantly decreasing the process time and cost of MMC manufacture. Other features and advantages of the present invention will become apparent from the following detailed description, as well as the accompanying drawings which illustrate, by way of example, certain principles of a preferred embodiment of the invention.

DETAILED DESCRIPTION OF THE PREFERRED EMBODIMENT

The present invention provides in certain preferred embodiments an apparatus and method for more efficiently producing stir-cast metal matrix composites and, in the most preferred embodiments, an apparatus and method for producing MMCs under atmospheric or near-atmospheric pressure. This invention addresses the major problems or disadvantages of the existing stir-cast technology, including a reduction in mixing time, the elimination of vacuum equipment, and the potential for continuous MMC processing.

Figure 1A:
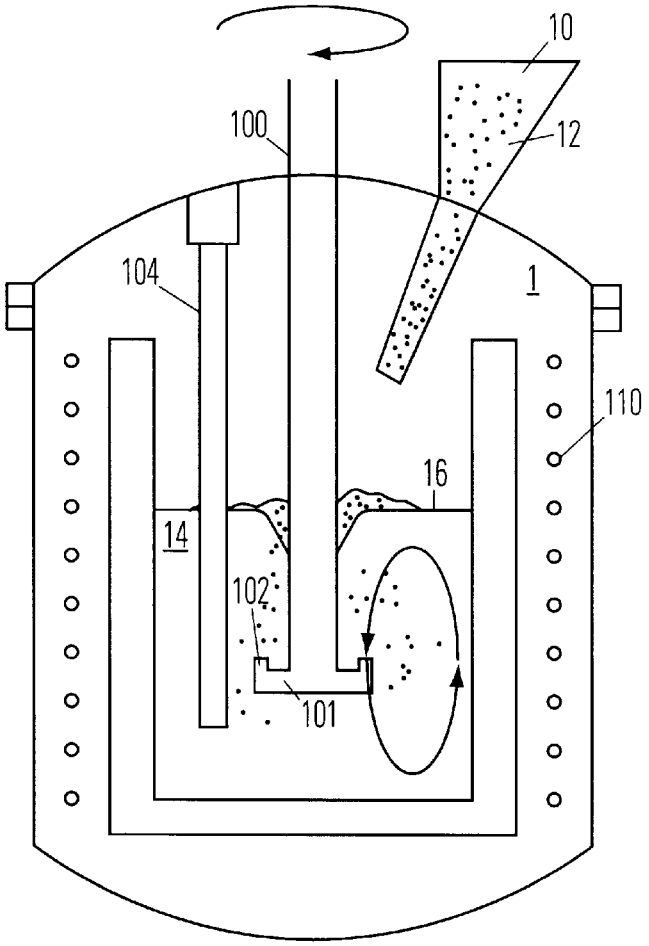
FIG. 1*a* is a schematic side sectional view of a conventional stir-cast mixing apparatus.
Figure 1B:
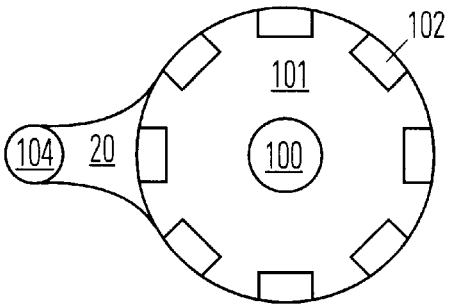
FIG. 1*b* is a top view of the impeller shaft and baffle of FIG. 1*a;*

Referring now to the drawings, there is shown in FIG. 1*a* a schematic side sectional view of a conventional stir-cast mixing apparatus, such as that used in the Duralcan process discussed above. In the Duralcan process, an aluminum alloy is melted and degassed in a vacuum induction furnace, comprising a vacuum vessel 1 which contains the matrix 14 and which is heated to a temperature above the liquidus temperature of the alloy, and induction coils 110 which are circumferentially located in the vacuum vessel 1 and which surround the matrix 14. Referring again to FIG. 1*a,* an impeller shaft 100, comprising at its lower end a toothed ring 101 having a plurality of upwardly directed ring teeth 102, is inserted into the matrix 14 and the vacuum vessel 1 is sealed. The impeller shaft 100 and the toothed ring 101 are made of graphite, and the ring teeth 102 comprise ceramic blocks made of silicon carbide or silicon nitride, which are bonded to the graphite ring 101 to yield longer operational life under the abrasive conditions involved in stir-casting of ceramic particles in a composite matrix. A single round bar-shaped baffle 104, also made of graphite, is located adjacent to and in proximity to the toothed ring 101. The baffle 104 is kept stationary during the mixing process. The proximity of the baffle 104 to the rotating toothed ring 101 during mixing provides a shear region 20 in the volume between the baffle 104 and the toothed ring 101, as illustrated in FIG. 1*b.*

Once the vacuum vessel 1 is sealed, the vessel 1 is evacuated by use of a pump or the like (not shown) to a pressure of about 1–5 torr. The actual vacuum level is not critical; however, it is preferred that the pressure remain above about 0.1–1 torr to minimize the extraction of any volatile constituents of the alloy (e.g., magnesium) from the matrix by evaporation. Once such vacuum level has been achieved, the vessel 1 containing the induction coils 110 is switched to the mixing cycle, causing movement of the molten alloy up the walls of the vessel 1 and down the center of the matrix 14, as illustrated by the vertical ellipse with counter-clockwise pointing arrows in FIG. 1*a*. In principle, this action helps bring the alloy into the vicinity of the centrally-located impeller shaft 100 and to homogenize the overall matrix 14. In reality, the induction mixing force in a large vessel, such as that used in the Duralcan process, is weak and most of the overall agitation of the matrix is provided by the rotating impeller.

The next step in the Duralcan process is to begin rotation of the impeller. The impeller used in the Duralcan process is so heavy that it requires approximately five minutes to come to its operational speed of 400 to 500 rpm. At that time, ceramic particles 12, typically made of silicon carbide or aluminum oxide (depending on the composite system) are added to the matrix surface 16 from an evacuated particle container 10. The particles 12 pass through a rotating gate valve (not shown) and fall under gravity onto the matrix surface 16. A mass of particles builds up on the matrix surface 16 around the impeller shaft 100 and is slowly drawn beneath the matrix surface 16 into the body of the matrix 14. The particle feed rate must be adjusted to prevent a mass of particles from covering the entire surface and choking the mixing action, further slowing the entry of particles.

Moreover, due to self-agglomeration forces, the particles 12 are drawn into the matrix 14 as small clumps or agglomerates, which must first be broken down before they can be wetted by the alloy. In addition, although the molten alloy is under vacuum, there is an oxide layer on the matrix surface 16. As a result, particles 12 added to the matrix surface 16 carry oxide skins down with them as they are drawn into the body of the matrix 14. These oxide skins, composed of aluminum oxide, surround the particles and can inhibit the ability of the matrix to wet the particles and can lead to prolonged mixing times.

Once the particle agglomerates are finally pulled beneath the matrix surface 16, they approach the rotating impeller shaft 100 and toothed ring 101 and, eventually, enter the shear region 20 (see FIG. 1*b*) which exists in and around the volume between the rotating toothed ring 101 and the stationary baffle 104. In this manner, the particle agglomerates are broken down and the individual particles become wetted. However, because the particles 12 must be drawn down into the body of the matrix 14 from the matrix surface 16, they must travel a considerable distance before reaching the shear region 20, thereby prolonging the mixing and wetting processing time. Also, because of the small shear region volume in this process, it is likely that numerous passes through the shear region 20 are required to completely wet the particles 12. To illustrate, in the fabrication of a 14,000 lb. batch of MMC material using an apparatus such as that illustrated in FIG. 1*a,* up to approximately 60–75 minutes are required to add the ceramic particles to the matrix surface 16, followed by up to about 60 minutes of mixing to complete the wetting. At this point, the vessel 1 is vented to the atmosphere and then the composite is cast into extrusion billet or foundry ingot.

Figure 2A:
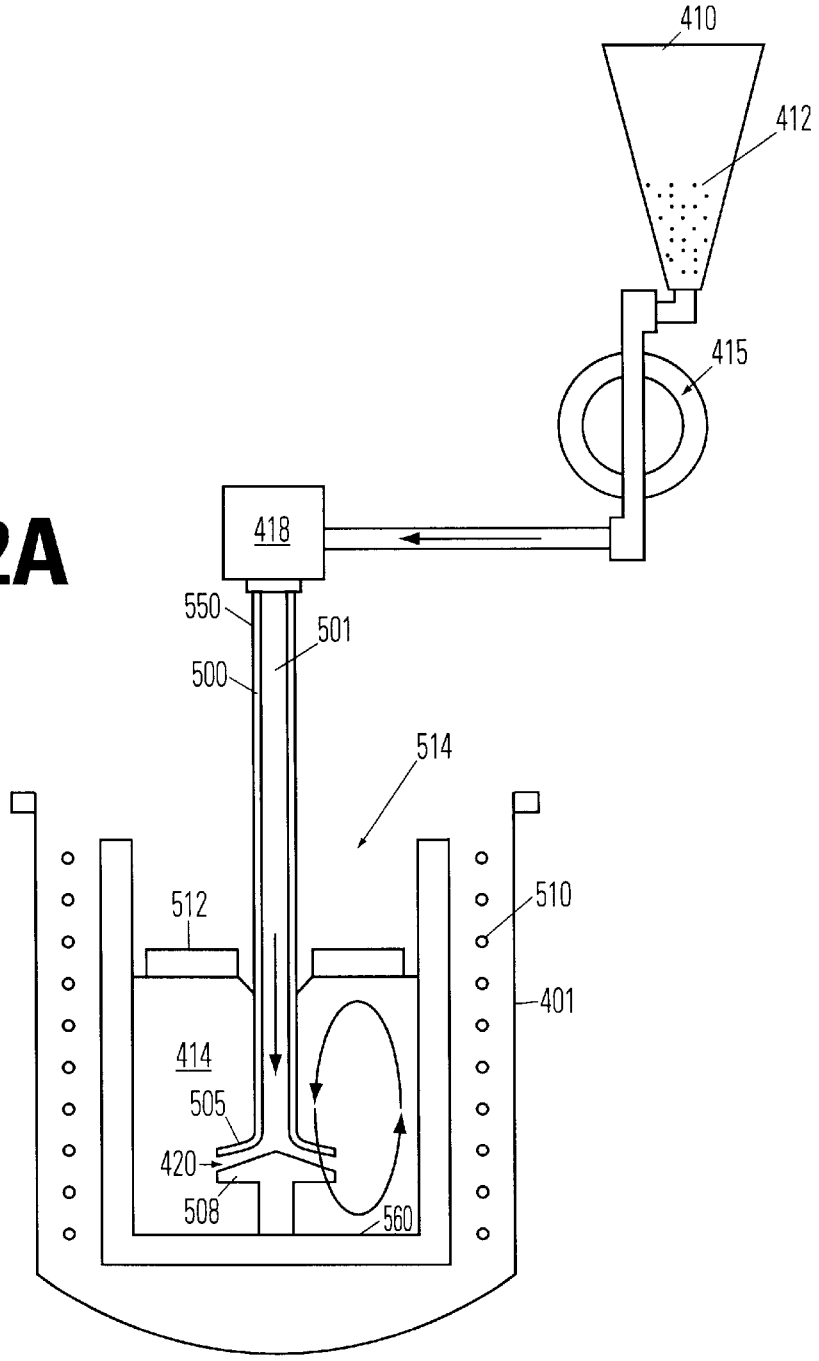
FIG. 2*a* is a schematic side sectional view of an embodiment of a mixing apparatus in accordance with the present invention.

An exemplary embodiment of the present invention for the production of metal matrix composite materials under atmospheric or near-atmospheric pressure is illustrated in FIG. 2*a*. In this embodiment, a vessel 401 has a side wall and a bottom wall and defines a chamber for receiving a matrix, such as a molten metal or metal alloy. The impeller 550 includes a hollow impeller tube 500 having an inner passage 501 into which the particles 412 are directed. The particles 412 are fed through the inner passage 501 and are introduced into the body of the matrix 414 through the lower end of the impeller tube 500 at a point below the matrix surface. In this embodiment, the lower end of the impeller tube 500 includes an impeller head 505 which projects radially outward from the impeller tube 500. The shape of the impeller head is not critical and may include, among other shapes, disk-like, conical, and flared horn. The impeller 550 is preferably positioned centrally within the vessel 401 to maximize agitation during mixing.

It is preferred that the impeller head 505 is made of a ceramic, although other sufficiently durable materials may be used, so long as they are able to withstand the erosive effects from high-speed rotation within a ceramic particle-filled composite matrix. Such other materials are well known in the art. Suitable ceramic materials include nitrides, silicides, oxides, and carbides. Particularly preferred ceramics include silicon carbide, aluminum oxide, boron carbide, silicon nitride, and boron nitride.

Preferably, the impeller head 505 is located proximate to (i.e., at or near) the lower or distal end of the impeller tube 500 and projects radially outward from the impeller tube 500. The radial projection of the impeller head from the impeller tube 500 need not be planar and may be at essentially any angle relative to the longitudinal axis of the impeller tube 500, and may, accordingly, be generally shaped as a disk, a cone or a flared horn. The impeller head 505 is integral with the impeller tube 500 or may be attached to the impeller tube 500 in any manner such that it rotates when the impeller 550 is rotated. The attachment may be made by way of, for example, a weld, a screw, a bolt, glue, or the like. Rotation of the impeller may be accomplished by any appropriate apparatus such as a motor or the like; in addition, the motor can be placed either internal or external to the vessel, although it is preferable in the case of MMC manufacture that the motor is external to the vessel because of the elevated temperatures within the vessel during MMC processing. The impeller tube 500 may include additional impeller heads or the like along its length to increase the volume of entrained matrix during mixing.

Figure 2B:
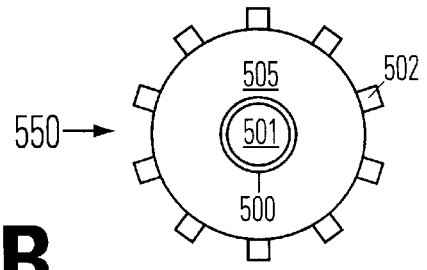
FIG. 2*b* is a top view of the impeller tube and the impeller head of FIG. 2*a.*

Preferably, the impeller head 505 is substantially circular when viewed in plan. It is also preferred that the impeller head 505 comprises one or more teeth 502 proximate to its outer or peripheral edge. Most preferably, the one or more teeth 502 extend radially outward from the impeller head 505, as illustrated in FIG. 2*b*. The one or more teeth 502 may be made of any appropriately durable material, again keeping in mind that the teeth should be able to withstand the high erosion incurred by rotation within a matrix containing, for example, ceramic particles. Thus, it is preferred that the one or more teeth 502 are block-shaped and made of a ceramic such as an oxide, a nitride, a silicide, or a carbide. Particularly preferred ceramic materials include silicon carbide, aluminum oxide, boron carbide, silicon nitride, and boron nitride.

Preferably, the impeller head 505 is proximate to (i.e., within a small distance of) an impeller base 508, so as to define in the matrix 514 a shear region 420 in the volume between and around the impeller head 505 and the impeller base 508 when the impeller 550 is rotated. The impeller base 508 may be the inner bottom wall 560, or a portion thereof. Preferably, however, the impeller base 508 comprises a projection positioned above the inner bottom wall 560, as illustrated in FIG. 2*a*. Preferably also, the impeller base 508 comprises one or more teeth to maximize interaction with the impeller head 505 and thereby maximize the shear force. In the embodiment of FIG. 2*a,* the impeller base 508 is attached to and extends upward from the inner bottom wall 560, although the impeller base 508 may extend from, for example, an inner side wall of the vessel 401. Where the impeller base 508 comprises a projection positioned above the inner bottom wall 560, the impeller head 505 is preferably positioned approximately one-third of the distance in the matrix body 414 from the inner bottom wall 560 (i.e., two-thirds of the distance from the matrix surface); however, the location of the impeller head 505 may be varied within broad limits depending on the vessel geometry, matrix depth, impeller design and impeller base location.

It is preferred that the impeller base 508 is generally shaped and oriented so that its contours are complementary with the contours of the impeller head 505, and is similar in size to the impeller head 505, such as that illustrated in FIG. 2*a*. Thus, if the impeller head 505 is generally in the shape of a concave cone, the impeller base 508 is preferably a convex cone of similar size whose outer contours are substantially parallel to the inner contours of the cone-shaped impeller head 505. By making the impeller base 508 similar in size and shape to the impeller head 505, the size of the shear region 420 is increased so that it exists between and around the volume between the impeller base 508 and the impeller head 505. The shear force generated in the shear region 420 is a function of the distance between the impeller head 505 and the impeller base 508, such that the closer they are to each other, the higher the shear force created between them. One skilled in the art would be able to determine the optimum spacing based on, among other factors, the impeller speed, the matrix viscosity, the size of the particles, and the particle flow rate. In general, the spacing should be as close as possible to maximize the shear force, but far enough to prevent clogging of the shear region with particles or occasional contact of and damage to the impeller base 508 and the impeller head 505 during impeller rotation.

Similarly, in order to increase the shear force in the shear region, the impeller rotational speed should be increased. It is preferred that during the mixing of a MMC the impeller is rotated at a speed achieving at least about 1000 to 2000 surface feet per minute. Such rotational speed is sufficient to provide rapid mixing of particles. The rate of wetting is increased due to the fact that the particles 412 are introduced to the matrix body 414 through the shear region 420. Thus, essentially all of the particles 412 fed into the matrix body 414 are immediately sheared into the matrix at the point of maximum shear force, and do not have to travel long distances in the matrix before passing through the shear region, as occurs when the particles are added to the matrix surface.

In the embodiment of FIG. 2*a,* the vessel 401 is designed to hold a matrix, and may further have means for heating the vessel. The impeller tube 500 extends through the outer housing of the vessel 401 and into the body of the matrix 414. In this embodiment, ceramic particles 412 are pumped, i.e., mechanically driven under force, by a solids pump 415 from a particle supply 410 into the inner passage 501 of the impeller tube 500 via a rotating union 418. Preferably, the particles are preheated and dried prior to introduction in order to facilitate flow. The particle supply 410 is preferably a hopper or container or the like, although continuous flow processes are possible. The design of the apparatus for feeding or pumping the ceramic particles 412 into the impeller tube 500 is not critical to the present invention so long as such feeding or pumping does not require large amounts of carrier gas or the like which could become entrapped within the matrix. Suitable apparatus include, but are not limited to, solids pumps, diaphragms, and rotating unions.

The overall direction of movement in the matrix body 414 caused by the rotating impeller and one or more induction coils 510 is represented by the vertical ellipse with counterclockwise pointing arrows in FIG. 2*a*. This movement aids to bring the composite matrix into the vicinity of the impeller for additional passes through or near the shear region 420 and to homogenize the overall composite.

The embodiment illustrated in FIG. 2*a* comprises a vessel 401 for the mixing and production of MMCs under atmospheric or near-atmospheric pressure. Because the particles 412 do not pass through the matrix surface, the problem of oxide skins being entrained with the particles into the matrix is essentially eliminated, leading to greatly reduced wetting times and higher quality MMC product. Moreover, the agglomeration problem associated with particle addition at the matrix surface is avoided. Additional agitation of the matrix to further decrease mixing times may be supplied by one or more induction coils 510.

In an alternate but less preferred embodiment (not shown), the particles may be directed through a hollow tube or the like (other than the impeller) such that the particles are introduced into the matrix under the matrix surface at a location proximate to a high shear region. In such an embodiment, the high shear region is preferably created between a rotating impeller and an impeller base in a manner similar to that described above for FIG. 2*a*. The impeller shaft in this embodiment may be either hollow or solid, since the particles are introduced through a separate tube.

Other aspects of the apparatus relating to the production of MMCs in general and to post-production (e.g., casting) are not particularly critical to the present invention. Such aspects would be apparent to one skilled in the art from the present teachings and from the prior art. For example, the process conditions (e.g., temperature) and the design of various components of the production equipment not specifically described here would be apparent to those skilled in the art. Such process conditions, parameters, and considerations are discussed in, for example, in U.S. Pat. No. 5,531,425.

Both the vessel 401 and the particle supply 410 may be kept at atmospheric or near-atmospheric pressure during the MMC manufacturing process. Thus, it is not required that the vessel 401 be closable or sealable. However, because the particle supply 410 is preferably back-filled with a gas, it should be sealable so that little or no leakage of gas (especially lighter-than-air gases like helium) occurs.

Preferably, the matrix surface is substantially covered with a cover 512 to inhibit the formation of a vortex in the matrix due to the rotating impeller 550. The cover 512 minimizes turbulence at the matrix surface and ensures that most of the agitation of the matrix occurs under the matrix surface. The cover 512 is preferably made of a low-density ceramic material (e.g., alumina or silica lightweight refractory board), so that it substantially floats on the matrix surface. The formation of a vortex is disadvantageous because the presence of a vortex is known to inhibit particle wetting by incorporating gas into the matrix.

Optionally, the inner volume of the vessel 401 above the cover 512 may also be filled with a substantially inert gas cover 514 to blanket the matrix surface and inhibit reactions which might occur at the surface of an active molten metal. This gas cover 514 preferably comprises argon, nitrogen, or helium, although other substantially inert gases (e.g., other noble gases) may be used.

The particle supply 410 is preferably back-filled with an active gas like oxygen to accompany the particles 412 into the molten metal matrix 414. Oxygen is extremely reactive with aluminum and when introduced into molten aluminum completely reacts to form aluminum oxide. Accordingly, when particles 412 are injected into a molten metal matrix 414, the accompanying oxygen is instantly scavenged to form an oxide of the metal, thereby eliminating the presence of gases in the composite matrix which could impede the wetting process or lead to porosity.

In an alternate but less preferred embodiment, the particle supply 410 may be back-filled with a substantially inert gas such as argon, nitrogen or helium, instead of oxygen. These gases, unlike oxygen, do not react with the molten metal and therefore can potentially impede wetting of the particles or lead to the formation of some porosity due to gas retention. However, because very little gas volume is involved in this process, porosity and slowing of the wetting process are minimized. In any event, when the particles 412 are injected into the matrix 414, the entrained gas would slowly leave the matrix. Helium gas is most preferred because it would exit the matrix most rapidly. However, helium is also expensive and, because it is lighter than air, it may also be difficult to retain in the particle supply 410 during the process. Heavier inert gases would probably not exit the melt as easily and could potentially lead to a low level of porosity, but such effects can be minimized by decreasing the volume of gas.

Preferably, the metal or metal alloy used in the present invention comprises aluminum, although other metals such as magnesium may also be used. The particles are preferably made of a metal oxide, a metal nitride, a metal carbide, a metal silicide, or a glass. The most preferred MMC is an aluminum alloy matrix containing silicon carbide or aluminum oxide particles for reinforcement.

The process of the present invention may be carried out as a batch process or as a continuous process. In the latter process, liquid metal or metal alloy may be continuously fed into the vessel while molten composite is being withdrawn. The peripheral equipment necessary to construct a continuous MMC manufacturing apparatus is known in the art.

As described above, the present invention provides several embodiments that have a wide range of applications, as scaling of the configurations can be readily accomplished by those skilled in the art. Various modifications and equivalent substitutes may be incorporated into the invention as described above without varying from the spirit of the invention, as will be apparent to those skilled in this technology. Furthermore, the drawings presented herein are intended to illustrate particular embodiments of the present invention and are not intended to act as a limitation on the scope of the following claims.

What is claimed is:

1. A method for mixing nonmetallic particles into a matrix under approximately atmospheric pressure to produce a metal matrix composite, wherein said matrix comprises a molten metal and includes a matrix surface and a matrix body, said method comprising:

(a) rotating an impeller positioned in said matrix body to create a shear region in said matrix body under said matrix surface; and (b) directing said particles from a particle supply backfilled with a gas into said matrix body so that said particles are introduced into said matrix body at a location proximate to said shear region, said gas comprised of an active gas such that said active gas is available to be scavenged to reduce unwanted gas within said matrix and to also reduce porosity within said matrix by substantially eliminating the presence of gases in said matrix.

2. The method of claim 1, wherein the molten metal comprises aluminum.

3. The method of claim 1, wherein the nonmetallic particles are made of a ceramic material selected from the group consisting of nitrides, silicides, oxides, and carbides.

4. The method of claim 3, wherein the ceramic material is selected from the group consisting of silicon carbide, aluminum oxide, boron carbide, silicon nitride, and boron nitride.

5. The method of claim 1, wherein the gas comprises oxygen.

6. A method for mixing nonmetallic particles into a matrix under approximately atmospheric pressure to produce a metal matrix composite, wherein said matrix comprises a molten metal and includes a matrix surface and a matrix body, said method comprising:

(a) rotating an impeller comprising an impeller tube, said impeller tube having an inner passage and an impeller head, wherein said impeller head is positioned in said matrix body under said matrix surface;

(b) directing said particles from a particle supply backfilled with a gas through said inner passage of said impeller tube, said gas comprised of an active gas such that said active gas is available to be scavenged to reduce unwanted gas within said matrix and to also reduce porosity within said matrix by substantially eliminating the presence of gases in said matrix;

(c) creating a shear region between said rotating impeller head and an impeller base positioned proximate to said impeller head; and (d) introducing said particles into said matrix body under said matrix surface by directing said particles from said inner passage through said shear region.

7. The method of claim 6, wherein the molten metal comprises aluminum.

8. The method of claim 6, wherein the nonmetallic particles are made of a ceramic material selected from the group consisting of nitrides, silicides, oxides, and carbides.

9. The method of claim 8, wherein the ceramic material is selected from the group consisting of silicon carbide, aluminum oxide, boron carbide, silicon nitride, and boron nitride.

10. The method of claim 6, wherein the gas comprises oxygen.

11. The method of claim 6, wherein the matrix surface is substantially covered with a cover to inhibit vortex formation.

12. The method of claim 11, wherein the cover is made of a ceramic material.

13. The method of claim 6, wherein the matrix surface is blanketed with a substantially inert gas.

14. The method of claim 6 for continuous production of a metal matrix composite, wherein the matrix is continuously fed into the vessel, the particles are continuously introduced into the matrix body, and the metal matrix composite material is continuously withdrawn from the vessel.

15. A method for mixing nonmetallic particles into a matrix under approximately atmospheric pressure to produce a metal matrix composite, wherein said matrix comprises a molten metal and includes a matrix surface and a matrix body, said method comprising:

(a) rotating an impeller comprising an impeller head, wherein said impeller head is positioned in said matrix body under said matrix surface;

(b) directing said particles from a particle supply backfilled with a gas through a particle tube positioned in said matrix, said gas comprised of an active gas such that said active gas is available to be scavenged to reduce unwanted gas within said matrix and to also reduce porosity within said matrix by substantially eliminating the presence of gases in said matrix;

(c) creating a shear region between said rotating impeller head and an impeller base positioned proximate to said impeller head; and (d) introducing said particles into said matrix body under said matrix surface by directing said particles from said particle tube into said matrix body at a location proximate to said shear region.

* * * * *